US006690005B2

(12) United States Patent
Jenkins et al.

(10) Patent No.: US 6,690,005 B2
(45) Date of Patent: Feb. 10, 2004

(54) ION MOBILITY SPECTROMETER

(75) Inventors: Anthony Jenkins, North Reading, MA (US); William J. McGann, North Raynham, MA (US)

(73) Assignee: General Electric Company, Schenectady, NY (US)

( * ) Notice: Subject to any disclaimer, the term of this patent is extended or adjusted under 35 U.S.C. 154(b) by 8 days.

(21) Appl. No.: 09/910,197

(22) Filed: Jul. 20, 2001

(65) Prior Publication Data

US 2002/0017605 A1 Feb. 14, 2002

Related U.S. Application Data

(60) Provisional application No. 60/222,487, filed on Aug. 2, 2000.

(51) Int. Cl.[7] ..... H01J 49/40
(52) U.S. Cl. ..... 250/287; 250/286
(58) Field of Search ..... 250/287, 286, 250/282

(56) References Cited

U.S. PATENT DOCUMENTS 6,407,382 B1 * 6/2002 Spangler ..... 250/286

* cited by examiner

*Primary Examiner*—John R. Lee
*Assistant Examiner*—Phillip A Johnston
(74) *Attorney, Agent, or Firm*—Anthony J. Casella; Gerald E. Hespos

(57) ABSTRACT

An ion trap mobility spectrometer is provided with a reaction chamber and a drift chamber. Ions are produced in the reaction chamber by high voltage electronic pulses. More particularly, the ions are formed periodically and are allowed to thermalize in a field-free environment of the reaction chamber. The ions then react with molecular species in the gas phase in the reaction chamber. After a short period, the ions are pulsed into the drift section and are collected on a collector electrode disposed at the end of the drift chamber remote from the reaction chamber. The reaction period may be varied to sample the ion population at different intervals. This enables the ion-molecule reactions to be monitored as the ion population approaches equilibrium. The monitoring results can be used to determine differences between reacting species because the molecular ion population varies at different time points approaching equilibrium. This in turn provides improved identification of target materials.

6 Claims, 2 Drawing Sheets

ION MOBILITY SPECTROMETER

This application claims priority on U.S. Provisional Patent Application No. 60/222,487, filed Aug. 2, 2000.

BACKGROUND OF THE INVENTION

1. Field of the Invention

The subject invention relates to ion mobility spectrometers, and particularly to the method of generating ions and the sampling of the ionic population at different intervals as the ion molecule reactions proceed to equilibrium.

2. Description of the Related Art

Ion mobility spectrometers have been used for many years to determine whether molecules of interest are present in a stream of gas. The prior art ion mobility spectrometers function by acquiring a sample that is to be tested for the presence of the molecules of interest. Some prior art ion mobility spectrometers acquire the sample by wiping a woven or non-woven fabric trap across a surface that is to be tested for molecules of interest. Other prior art ion mobility spectrometers create a stream of gas adjacent the surface to be tested for the molecules of interest or rely upon an existing stream of gas. The sample is transported on a stream of inert gas to an ionization chamber. The prior art ion mobility spectrometer exposes the sample to a radio active material in the ionization chamber. The radio active material, such as nickel$^{63}$ or tritium bombards the sample stream with β-particles and creates ions.

The prior art ion mobility spectrometer further includes a drift chamber in proximity to the ionization chamber. The drift chamber is characterized by a plurality of field-defining electrodes and a collector electrode at the end of the drift chamber opposite the ionization chamber. Ions created in the ionization chamber are permitted to drift through the drift chamber and toward the collector electrode. The collector electrode detects and analyzes the spectra of the collected ions and provides an appropriate indication if molecules of interest are detected.

Ion mobility spectrometers have many applications, including security applications where the ion mobility spectrometer is used to search for and identify explosives, narcotics and other contraband. Examples of ion mobility spectrometers are shown in U.S. Pat. No. 3,699,333 and U.S. Pat. No. 5,027,643.

Improvements to the above-described early ion mobility spectrometer have been developed by Ion Track Instruments, Inc. and are referred to as ion trap mobility spectrometers. The ion trap mobility spectrometer provides greater sensitivity and reliability over the above-described ion mobility spectrometer. An example of an ion trap mobility spectrometer is described in U.S. Pat. No. 5,200,614 which issued to Anthony Jenkins. This prior art ion trap mobility spectrometer achieves improved operation by increasing ionization efficiency in the reactor and ion transport efficiency from the reactor to the collector electrode. More particularly, the ionization chamber of the ion trap mobility spectrometer is a field-free region where the ion population of both electrons and positive ions is allowed to build up by the action of the β-particles on the carrier gas. The high density of ions produces a very high probability of ionization of the molecules of interest, and hence an extremely high ionization efficiency.

U.S. Pat. No. 5,491,337 shows still further improvements to ion trap mobility spectrometers. More particularly, U.S. Pat. No. 5,491,337 discloses an ion trap mobility spectrometer with enhanced efficiency to detect the presence of alkaloids, such as narcotics.

Despite the operational efficiencies described in the above-referenced patents, there is a demand for still further improvements that enable cost reductions while increasing the resolution or selectivity of the spectrometer. There are also regulatory barriers to using radioactive material in some countries which prevents the use of portable applications of equipment containing a radioactive source.

Recent attempts to provide an electronic means of ionization have been described in U.K. Patent Appl. No. 98164452. This does not however provide for ionic reactions to occur in zero field conditions or to probe these reactions as they proceed to equilibrium. Subsequently the method is both less sensitive and less selective than that described herein.

SUMMARY OF THE INVENTION

The subject invention is directed to an ion trap mobility spectrometer that replaces the radioactive ionization source with a source of ions produced by high voltage electronic pulses. Ions are formed periodically in a reaction chamber and are allowed to maximize their population and thermalize in a field-free environment and then react with molecular species in the gas phase in the reaction chamber. After a short time, the ions are pulsed into the drift section of an ion trap mobility spectrometer, such as the drift section of the ion trap mobility spectrometer disclosed in U.S. Pat. No. 5,200,614. The reaction period may be varied to sample the ion population at different intervals. This enables the ion-molecule reactions to be monitored as the ion population approaches equilibrium. Results then can be analyzed to determine differences between reacting species because the molecular ion population varies at different time points approaching equilibrium. Thus, there is an improved identification of targets.

DETAILED DESCRIPTION OF THE PREFERRED EMBODIMENT

Figure 1:
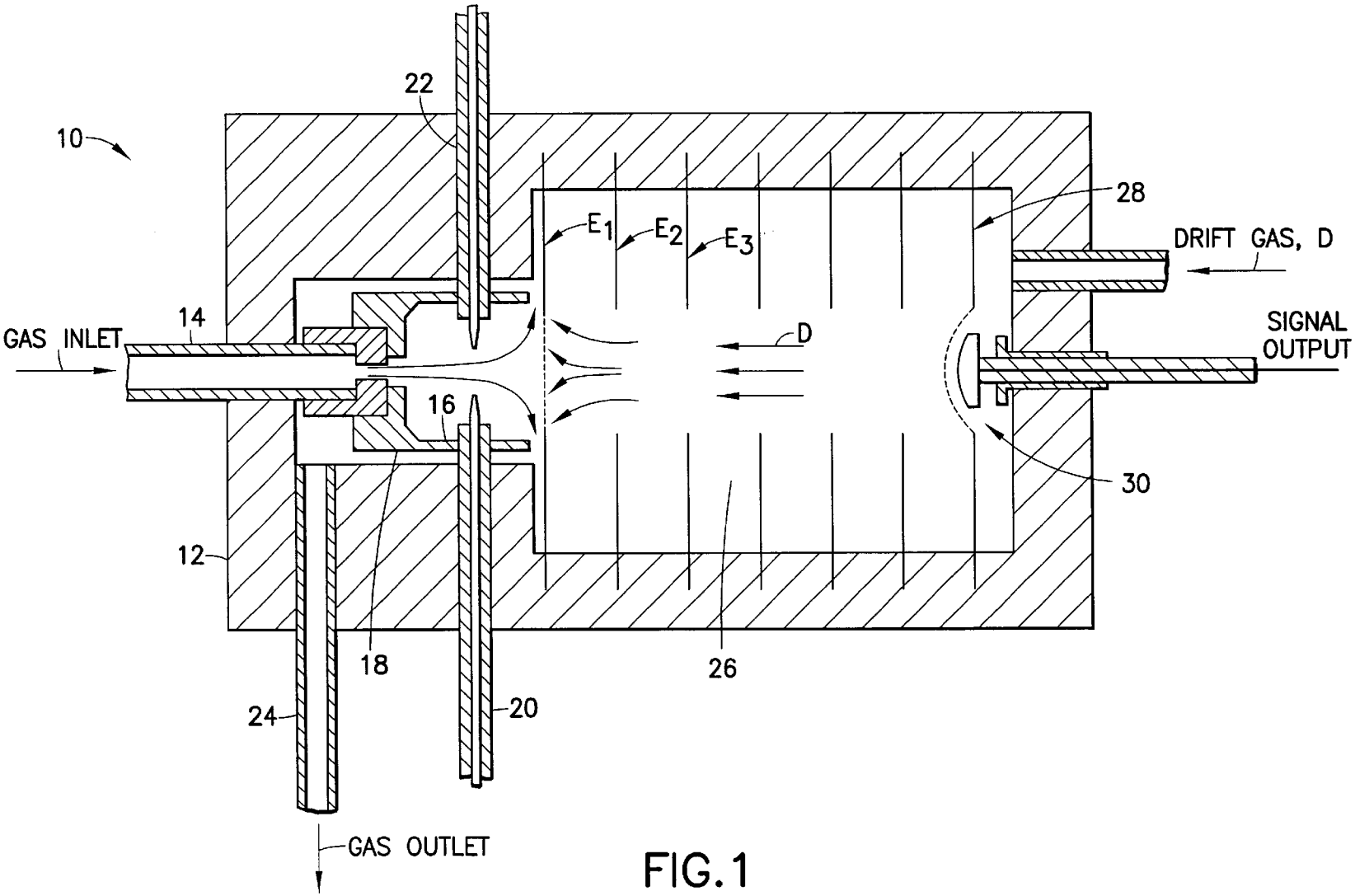
FIG. 1 is a schematic cross-sectional view of an ion trap mobility spectrometer in accordance with the subject invention.

An ion trap mobility spectrometer (ITMS) in accordance with the subject invention is identified generally by the numeral 10 in the FIG. 1. The ITMS 10 includes a cylindrical detector 12 having a gas inlet 14 at one end for receiving sample air of interest. The sample air of interest may be transported by a carrier gas.

This carrier typically is a clean and dry air that contains a small concentration of a dopant material, such as ammonia, nicotinamide or other such dopant, as disclosed in U.S. Pat. No. 5,491,337. Vapor samples from target materials are carried into the detector 10 on this gas stream from a suitable inlet system, such as the system described in U.S. Pat. No. 5,491,337.

Gas flow from the inlet 14 enters a reaction chamber 16. More particularly, the reaction chamber 16 is a hollow metallic cylindrical cup 18 with the inlet 14 at one end. Two pin electrodes 20 and 22 protrude radially into the reaction chamber. The pin electrodes 20, 22 are insulated to avoid discharge from places other than the radially inner points of each electrodes 20, 22. A grid electrode $E_1$ is provided at the opposite end of the reaction chamber 16 from the inlet 14. The grid electrode $E_1$ normally is maintained at the same potential as the inlet end and the walls of the reaction chamber 16. The creation of ions within the reaction chamber 16 will be described in greater detail below. The carrier gas passes through the reaction chamber 16, exhausts around the metallic cylindrical cup 18 and exits the detector through the gas outlet 24.

A drift section 26 is defined in the detector 10 downstream from the grid electrode $E_1$. The drift section 26 comprises a plurality of annular electrodes $E_2$–$E_N$. Clean drift gas is arranged to flow down the detector 10 through the drift region 26 in the direction indicated by the arrows D in the FIG. 1. The drift gas joins the carrier gas at the point at which the carrier gas leaves the reactor chamber 16, and both the drift gas and the carrier gas are exhausted from the detector through the outlet 24.

Most of the time, the electrical potentials on the metallic cylindrical cup 18, both pins 20, 22 and the grid $E_1$ are identical, thus defining the reaction chamber 16 as a field-free space. Periodically, however, a high voltage pulse is applied across the two pin electrodes 20, 22. Thus, the carrier gas is ionized by positive and negative corona discharge within the area of the reaction chamber 16 between the two pin electrodes 20. In a negative DC corona, electrons are given off by the cathode pins 20 and are accelerated in the very high field adjacent the point of the pin 20. Secondary ions thus are formed by bombardment of the carrier gas molecules. Mostly nitrogen positive ions and further electrons are produced in this secondary ionization process. The positive ions are attracted back into the cathode pin 20 where they cause further electrons to be emitted, thus maintaining the discharge. The electrons, meanwhile, move to a region of lower field strength and at some distance from the pin 20. These electrons cease to cause further ionization of the carrier gas. Additionally, the electrons travel across the chamber toward the anode 22. These electrons are well above thermal energies, and thus very few materials will interact to form negative ions. One notable exception, however, is oxygen. The oxygen will capture hypothermal electrons, thereby forming negative oxygen ions.

A major disadvantage of a simple corona as the potential source of ions for an ion mobility spectrometer is that charge transfer processes are inhibited at high energy. Another disadvantage is that fewer positive ions are available for ionic interactions, because they exist largely in the tiny volume surrounding the tip of the cathode 20. However, the detector 10 described above and shown in the FIG. 1 provides almost equal numbers of positive ions and negative ions. The ions in this quasi-neutral plasma are allowed to interact at thermal energies, thus achieving all of the advantages of the ion trap mobility spectrometer described in U.S. Pat. No. 5,200,614. This is achieved by short high voltage electrical pulses of high frequency applied across the two electrodes 20 and 22. The frequency typically is above 1 MHz so that the field collapses very rapidly before many electrons or positive ions can be collected at the relevant electrodes 20 and 22. The plasma between the pins builds up during the pulse. After the pulse is switched off, the ions rapidly thermalize and react with molecular species present in the reaction chamber 16. The charge transfer processes all proceed toward the formation of molecular ions that have the highest charge affinity. Depending on the molecular concentrations, charge may be transferred from one molecule species to another of higher affinity. U.S. Pat. No. 5,494,337 described one way of modifying this process using a dopant vapor (e.g., ammonia or nicotimamide), which has intermediate charge affinity between many interfering compounds and the target compounds of interest. The dopant vapor attracts and maintains the charge in the presence of interference molecules with weak charge affinity. However, the dopant vapor transfers the charge to the target molecule when they become present in the reaction chamber 16. This reduces the number of different types of ions that are present, which in turn reduces the occurrence of false positive identifications by the detector 10.

The discharge pulse in the detector 10 shown in the FIG. 1 is left on only for a sufficient time to generate enough charge to ensure efficient ionization of the target molecules. Typically the duration of the discharge pulse will be a few hundred microseconds, which is faster than the ions travel to the relevant electrode. Frequencies of 1 MHz or higher are preferred to achieve the required decay of the pin voltages.

After the discharge is switched off, approximately equal concentrations of positive and negative charges ensure that little or no space charge is generated within the reactor, thus maintaining a field-free space. This, in turn, allows all charges to reach thermal equilibrium quickly (<1 ms) at which point optimum charge transfer processes are encouraged. Molecules with the highest charge affinity ultimately will capture the charge from all other ionic species. If these high affinity molecules are present in the reaction chamber 16 only at parts per trillion concentrations, then only one interaction in $10^{12}$ will cause charge to be transferred from any particular lower affinity ion to the target molecules. At atmospheric pressures and the temperature of the detector 10, molecules typically interact (collide) at frequencies of about $10^8$ per second. Ion concentrations in the reaction chamber 16 are generated which ensure that equilibrium ionization is achieved within a few milliseconds. Before this point is reached, many ionic species may be observed which may be associated with the target material. For example, a sample of cocaine vapor introduced into the detector from sampling a suspicious parcel may contain drug cutting compounds and other alkaloids. These may exist at higher concentration, but the positive charge affinity of cocaine is so high that at equilibrium, all of the charge resides on the cocaine ions, and the cutting compounds and other alkaloids will not be detected. Similarly, in the negative ion mode, mixtures of explosives may not be identified completely, since the stronger electronegative species will predominate. Before the end point equilibrium is reached, however, the lower charge affinity compounds will be ionized and can be detected. In the present arrangement, plasmagrams are obtained at differing time intervals after injecting the ionic charge into the reaction chamber.

The above-described method for sampling the ionic populations at different times after the discharge pulse is switched off allows non-equilibrium ionization to be observed and used as a further criteria for differentiating molecular species. Variation of the delay between the discharge pulse and the sampling of the ions in the reaction chamber 16 allows charge transfer processes to be studied and used to identify target materials more accurately. This is achieved by controlling and varying the time between the discharge pulse and the application of a high electric field across the reaction chamber 16 from the metallic cylindrical cup 18 to the grid $E_1$. This high field is maintained across the reactor for just a sufficient time that most of the ions are expelled through the electrode $E_1$ into the drift section of the detector, in the same way as described in U.S. Pat. No. 5,200,614. The ions travel through the drift section 26 under the influence of electric fields defined by annular electrodes $E_2$, $E_3$ . . . and $E_N$. The ions pass through the guard grid 28 and are collected at the collector electrode 30. The different ionic species travel down the drift section 26 to different speeds, which depend on molecular size and shape. Each ionic species travels in a swarm and arrives at the collector electrode 30 in a gaussian-shaped concentration profile. This in turn produces a peak of current at the signal output. The signal is amplified and the drift time measured to provide identification of the ion swarm.

Figure 2:
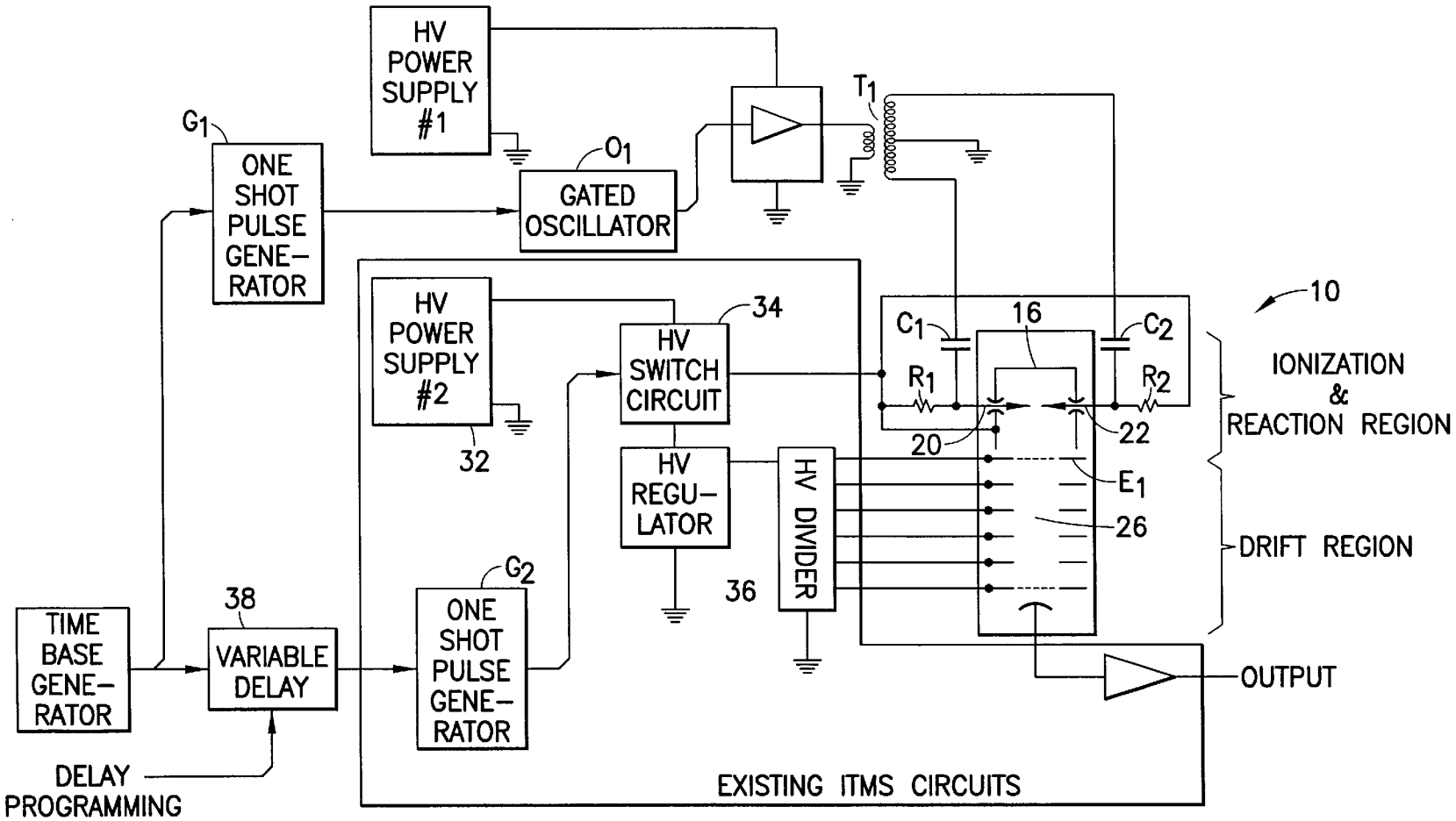
FIG. 2 is a schematic diagram of the circuitry for driving the electrodes of the ITMS shown in FIG. 1.

The dual opposing corona discharge points or pin electrodes 20 and 22 within the reaction chamber 16 of the ITMS 10 are driven with high voltage from two paths as shown in FIG. 2. For most of the time, the High Voltage Power Supply 32, HV Switch Circuit 34 and HV Regulator 36 operate to keep the pin electrodes 20 and 22 at the same high voltage (e.g., 1000 volts) as the rest of the walls of the reaction chamber 16 and first grid electrode, $E_1$. This is achieved via the high-value resistors $R_1$ and $R_2$. The HV Switch Circuit is arranged as in the prior art ITMS, to occasionally provide a kick out pulse of higher voltage so that ions are driven from the chamber through the first grid electrode, $E_1$ and down through the drift region of the detector.

At the completion of the drift period, ions are generated in the reaction chamber from the dual opposing corona pins 20 and 22 by the action of a high frequency, high voltage at each of the pins 20 and 22. The average voltage of the corona pins 20 and 22 is maintained at the level of the reaction chamber 16 surrounding them through the high value resistor $R_1$ and $R_2$. Additionally, high voltage at high frequency (>1 MHz) is fed to the pins 20 and 22 through small value capacitors $C_1$ and $C_2$ from the high voltage transformer $T_1$ which is supplied in turn form the gated oscillator $O_1$. Ions of both polarities are formed in the plasma between the pins 20 and 22 and the ionic population builds up without being discharged on the pins 20 and 22 themselves since the relative polarity of the pins 20 and 22 reverses before most of the ions have sufficient time to reach the pins 20 and 22 and discharge. The ionic density increases for a few hundred microseconds after which the gated oscillator $O_1$ is switched off by the action of the one-shot pulse generator $G_1$. At this point the pin voltages return to the same voltage as the walls of the reactor 16. The positive and negative ion populations are approximately equal and diffuse outwards from the region of the plasma into the rest of the reaction chamber 16 where interaction with molecules of interest occur.

The variable delay circuit 38 times out after a period variable from a few tens of microseconds to a few milliseconds, after which the one-shot pulse generator $G_1$ again causes the voltage of the reaction chamber 16 and pins 20 and 22 to increase above that of the grid electrode $E_1$. This in turn ejects ions from the reaction chamber 16 into the drift region 26 and the process starts over again.

While the invention has been described with respect to a preferred embodiment, it is apparent that various changes can be made without departing from the scope of the invention as defined by the appended claims.

What is claimed is:

1. An ion trap mobility spectrometer for analyzing sample molecules and for identifying the presence of molecules of interest among the sample molecules, the ion trap mobility spectrometer comprising: an inlet for delivering the sample molecules into the ion trap mobility spectrometer, a drift section spaced from the inlet for accommodating a drift of ionized molecules, a collector electrode at an end of the drift section remote from the inlet for collecting ionized molecules drifting through the drift section and a reaction chamber disposed between the inlet and the drift section, the reaction chamber comprising electrodes for electronically generating a quasi-neutral plasma with substantially equal numbers of positive and negative thermalized reactant ions which are allowed to react with the sample molecules to form sample ions in the reaction chamber.

2. The ion trap mobility spectrometer of claim 1, wherein the electrodes for electronically generating plasmas of thermalized ions are operative for generating high voltage pulses having a duration of less than approximately 500 microseconds.

3. The ion trap mobility spectrometer of claim 2, wherein the electrodes for generating plasmas of thermalized ions are operative for generating high voltage pulses that have a frequency of greater than 1 MHz.

4. The ion trap mobility spectrometer of claim 3, further comprising means for varying the time between ion generation and ion sampling to detect ions during a charge transfer processes occurring before equilibrium.

5. A method for detecting molecules of interest from among sample molecules, said method comprising the steps of generating a flow of the sample molecules, imparting high voltage pulses for durations of less than 500 microseconds for electronically generating a quasi-neutral plasma of substantially equal numbers of positive and negative thermalized reactant ions, allowing the thermalized reactant ions to react with sample molecules to form sample ions in the reaction chamber and allowing the ions to drift through a drift section and detecting characteristics of the ions at an end of the drift section remote from the reaction chamber for identifying the molecules of interest.

6. The method of claim 5, wherein the high voltage pulses have a frequency of at least 1 Mhz.

* * * * *